US012104826B2

(12) United States Patent
Yuge et al.

(10) Patent No.: US 12,104,826 B2
(45) Date of Patent: Oct. 1, 2024

(54) WATER HEATER

(71) Applicant: RINNAI CORPORATION, Aichi (JP)

(72) Inventors: Ryosuke Yuge, Aichi (JP); Takaaki Nakagoshi, Aichi (JP)

(73) Assignee: RINNAI CORPORATION, Aichi (JP)

( * ) Notice: Subject to any disclaimer, the term of this patent is extended or adjusted under 35 U.S.C. 154(b) by 0 days.

(21) Appl. No.: 17/679,732

(22) Filed: Feb. 24, 2022

(65) Prior Publication Data

US 2022/0333819 A1 Oct. 20, 2022

(30) Foreign Application Priority Data

Apr. 16, 2021 (JP) ..... 2021-069595

(51) Int. Cl.
*F24H 1/14* (2022.01)

(52) U.S. Cl.
CPC ..... *F24H 1/14* (2013.01)

(58) Field of Classification Search
CPC . F24H 1/14; F24H 1/142; F24H 1/145; F24H 1/147; F24H 1/10; F24H 1/12; F24H 1/16
USPC ..... 122/14
See application file for complete search history.

(56) References Cited

U.S. PATENT DOCUMENTS 3,920,067 A * 11/1975 Schindler ..... F24H 1/145 122/406.1
2012/0174333 A1* 7/2012 Heidacker ..... F28F 1/24 15/250.01
2018/0058722 A1* 3/2018 Cool ..... F24H 15/184

FOREIGN PATENT DOCUMENTS

JP 2000009344 A * 1/2000
JP 2020204428 A * 12/2020

OTHER PUBLICATIONS

English Translation of JP-2020204428-A, dated Mar. 8, 2023 (Year: 2023).*
English Translation of JP-2000009344-A, dated Feb. 28, 2024 (Year: 2024).*

* cited by examiner

*Primary Examiner* — Edelmira Bosques
*Assistant Examiner* — Brett Peterson Mallon
(74) *Attorney, Agent, or Firm* — Future IP LLC; Tomoko Nakajima

(57) ABSTRACT

In a water heater provided with an inlet pipe a downstream end of which is connected with an upstream end of a water heating channel of a heat exchanger for producing hot water, an outlet pipe an upstream end of which is connected with a downstream end of the water heating channel, and a bypass pipe branching at a part of the inlet pipe, which is positioned at an upstream-end part away from an upstream end, and is connected with a part of the outlet pipe, which is positioned at a more downstream part than at an upstream end, a connecting part of the bypass pipe with the outlet pipe and another connecting part of an inlet pipe and the upstream end of the water heating channel are arranged at a same height in a setting state of the water heater.

4 Claims, 4 Drawing Sheets

WATER HEATER

This application claims priority under 35 U.S.C. § 119 to Japanese Patent Application No. 2021-069595, filed Apr. 16, 2021, which is incorporated by reference.

TECHNICAL FIELD

The invention relates to a water heater provided with a heat exchanger which has a water heating channel structured by successively connecting each of a plurality of heat absorbing pipes aligned in parallel and produces hot water by heating water while flowing the water in the water heating channel, and a heat resource for having each of the heat absorbing pipes absorb heat by heating the heat exchanger.

BACKGROUND ART

Conventionally, as this kind of the water heater, there has been known one in which an inlet pipe upwardly extending to the heat exchanger for introducing the water into the water heating channel, a downstream end of which is connected with an upstream end of the water heating channel of the heat exchanger, and an outlet pipe extending away from the heat exchanger for downwardly flowing the hot water out of the water heating channel, an upstream end of which is connected with a downstream end of the water heating channel of the heat exchanger, are provided. See reference No. 1, for example. In this water heater, a bypass pipe branching at a part of the inlet pipe, which is positioned at a more upstream part than at the downstream end is connected with a part of the outlet pipe, which is positioned at a more downstream part than at an upstream end. The water flowing in the bypass pipe at a branching part from the inlet pipe is mixed with the hot water flowing in the outlet pipe and the hot water regulated at a preset temperature is produced in the water heater.

In the above-mentioned water heater, it is general that a temperature of the hot water flowing out of an outlet faucet temporarily falls at a time of resuming outflow of the hot water in the case where a passing time from stoppage of the outflow to resumption of the outflow of the hot water is prolonged. As one of the reasons of the above-identified phenomenon, it is exemplified that the hot water remains in the outlet pipe after stoppage of outflow flows back to the water heating channel.

In a setting state of the water heater, it is usual that a connecting part of the downstream end of the water heating channel of the heat exchanger with the outlet pipe is arranged at a higher position than at a connecting part of the outlet pipe with the bypass pipe, as a premise that one of the horizontal planes is a standard for defining height. A bottom face of a case of the water heater or the like is exemplified as the standard horizontal plane. After stopping outflow of the hot water, the hot water remains in the outlet pipe, specifically, in a part of the outlet pipe from the downstream end of the water heating channel of the heat exchanger to the connecting part of the outlet pipe with the bypass pipe and the water remains in a part of the inlet pipe positioned at the more downstream part than at the branching part of the bypass pipe and the bypass pipe. Since a specific gravity of the hot water is lighter than that of the water and a temperature of the hot water in a part from the downstream end of the water heating channel of the heat exchanger to the connecting part of the outlet pipe with the bypass pipe is the highest, the remaining hot water in the outlet pipe is liable to flow upwardly to the downstream end of the water heating channel of the heat exchanger. This flow is a reverse flow of the remaining hot water. Accompanying the reverse hot-water flow, the remaining water in a part at the more upstream part of the water heating channel of the heat exchanger and in the inlet pipe is liable to flow downwardly to the bypass pipe positioned at a lower position than at the upstream end of the outlet pipe and a part of the outlet pipe connected with the more downstream part of the bypass pipe.

The remaining water in the above-mentioned part of the inlet pipe and in the bypass pipe flows in the outlet pipe from the connecting part of the bypass pipe with the outlet pipe according to the above-identified reverse hot-water flow and descendance of the water accompanying the reverse hot-water flow. The water flowing in the outlet pipe is mixed with the hot water in the outlet pipe and the remaining hot water in the outlet pipe at the preset temperature changes a fluid mixture a temperature of which is lower than the preset temperature of the remaining hot water just after stoppage of outflow.

As a result, in the case where the passing time from the outflow stoppage to the outflow resumption is prolonged, not only the fluid mixture of the hot water and the water at a lower temperature than at the preset temperature flows out of the outflow faucet but also a time lag by flowing out the hot water at the preset temperature occurs. The outflow of the fluid mixture at the lower temperature than at the preset temperature and the time lag by the outflow of the hot water at the preset temperature give users discomfort feelings.

REFERENCE

Reference No. 1: JP2020-204428 A

SUMMARY OF INVENTION

Technical Problem

In the light of the above-mentioned problems, the invention provides a water heater which not only suppresses to flow out the fluid mixture of the hot water and the water at the lower temperature than at the preset temperature of the hot water from the outlet faucet but also shortens the time lag by flowing out the hot water at the preset temperature.

Solution to Problem

To solve the problems above-mentioned, the invention provides a water heater provided with a heat exchanger which has a water heating channel structured by successively connecting each of a plurality of heat absorbing pipes aligned in parallel and produces hot water by heating water while flowing water in the water heating channel, and a heat resource for heating the heat exchanger, comprising,

- an inlet pipe upwardly extending to the heat exchanger for introducing the water into the water heating channel, a downstream end of which is connected with an upstream end of the water heating channel of the heat exchanger;
- an outlet pipe, an upstream end of which is connected with a downstream end of the water heating channel of the heat exchanger, the outlet pipe extending away from the heat exchanger for downwardly flowing the hot water out of the water heating channel;
- a bypass pipe branching at a part of the inlet pipe, which is positioned at a more upstream part than at the downstream end, the bypass pipe being connected with a part of the outlet pipe, which is positioned at a more downstream part than at the upstream end, and the bypass pipe mixing the water in the outlet pipe, wherein, as a premise that one of horizontal planes is a standard for defining height, a connecting part of the bypass pipe with the outlet pipe and a connecting part of the inlet pipe with the upstream end of the water heating channel are arranged at a same height in a setting state of the water heater.

According to the above-identified water heater, even though there is a specific gravity between the hot water and the water, since the connecting part of the bypass pipe with the outlet pipe is positioned at as high as that of connecting part of the inlet pipe with the upstream end of the water heating channel, as the premise that one of the horizontal plane is the standard for defining height, the temperatures of the remaining water both in the inlet pipe and in the bypass pipe after the outflow stoppage of the hot water are same, i.e., the same specific gravity, the water cannot move in the direction to the outlet pipe. Therefore, the remaining hot water in the out let pipe cannot flow upwardly in the direction of the heat exchanger and the reverse hot-water flow in the water heating channel of the heat exchanger is suppressed to take place. Accordingly, if the passing time from the outflow stoppage to the outflow resumption is prolonged, the outflow of the fluid mixture of the hot water and the water at the lower temperature than at the preset temperature from the outlet faucet is suppressed at the time of the outflow resumption.

In the above-identified water heater, it is desirable that all of the heat absorbing pipes structuring the water heating channel of the water heater are arranged at a same height and are aligned in a single horizontal plane. As compared with a heat exchanger provided with a plurality of the water heating channels, each of which is arranged in a perpendicular direction, i.e., arranged in a different horizontal plane, and is successively connected, in the case where a water temperature at the upstream end of the water heating channel arranged in the lowest horizontal plane is as low as that of the water heating channel arranged in the single horizontal plane and a hot-water temperature at the downstream end of the water heating channel arranged in the highest horizontal plane is as high as that of the water heating channel arranged in the single horizontal plane, a temperature change amount of the water heating channel of the heat exchanger is larger than that of each of the water heating channels provide with the heat exchanger and arranged in the different horizontal planes. The above-mentioned explanation is now specifically described as follows: A heat exchanger provided with two water heating channels is exemplified, for example. One of the water heating channels is arranged in one horizontal plane and the other in the other horizontal plane. The former names an upper water heating channel and the latter a lower water heating channel. The upper water heating channel is successively connected with the lower water heating channel, the upstream end is provided with the lower water heating channel, and the downstream end is provided with the upper water heating channel. In this heat exchanger, since relatively hot water after being heated in the lower water heating channel flows in the upper water heating channel, the hot water with relatively small heat conductivity remains in the upper water heating channel and therefore the temperature change amount per one water heating channels is smaller. On the contrary, in the heat exchanger in which the water heating channel is arranged in the single horizontal plane, since all of the heat absorbing pipes are arranged at the same height, the hot water and the water remain in a water heating channel and therefore the heat temperature change amount is larger. Further, in order to absorb same amount of heat, it is necessary for the heat changer provided with a water heating channel a length of which is longer and amount of the remaining hot water and water in the water heating channel is more as compared with the heat exchanger provide with two water heating channels. Accordingly, suppressing movement of the hot water and the water is harder after the stoppage of outflow and the outlet pipe has a length to some extent so that the hot water upwardly flows and backflows in the water heating channel, resulting in easily taking place the reverse flow of the hot water. However, the suppress of the reverse hot-water flow becomes excellent by the heat exchanger provided with the water heating channel which is arranged in the single horizontal plane because, as above-mentioned, the connecting part of the bypass pipe with the outlet pipe and the connecting part of the inlet pipe with the upstream end of the water heating channel are arranged at the same height.

DESCRIPTION OF EMBODIMENTS

A water heater 1 as an embodiment is now explained with reference to drawings. Wordings which intend "upward" and "downward" in following explanations correspond to positional relationships in a setting state of the water heater 1.

Figure 1:
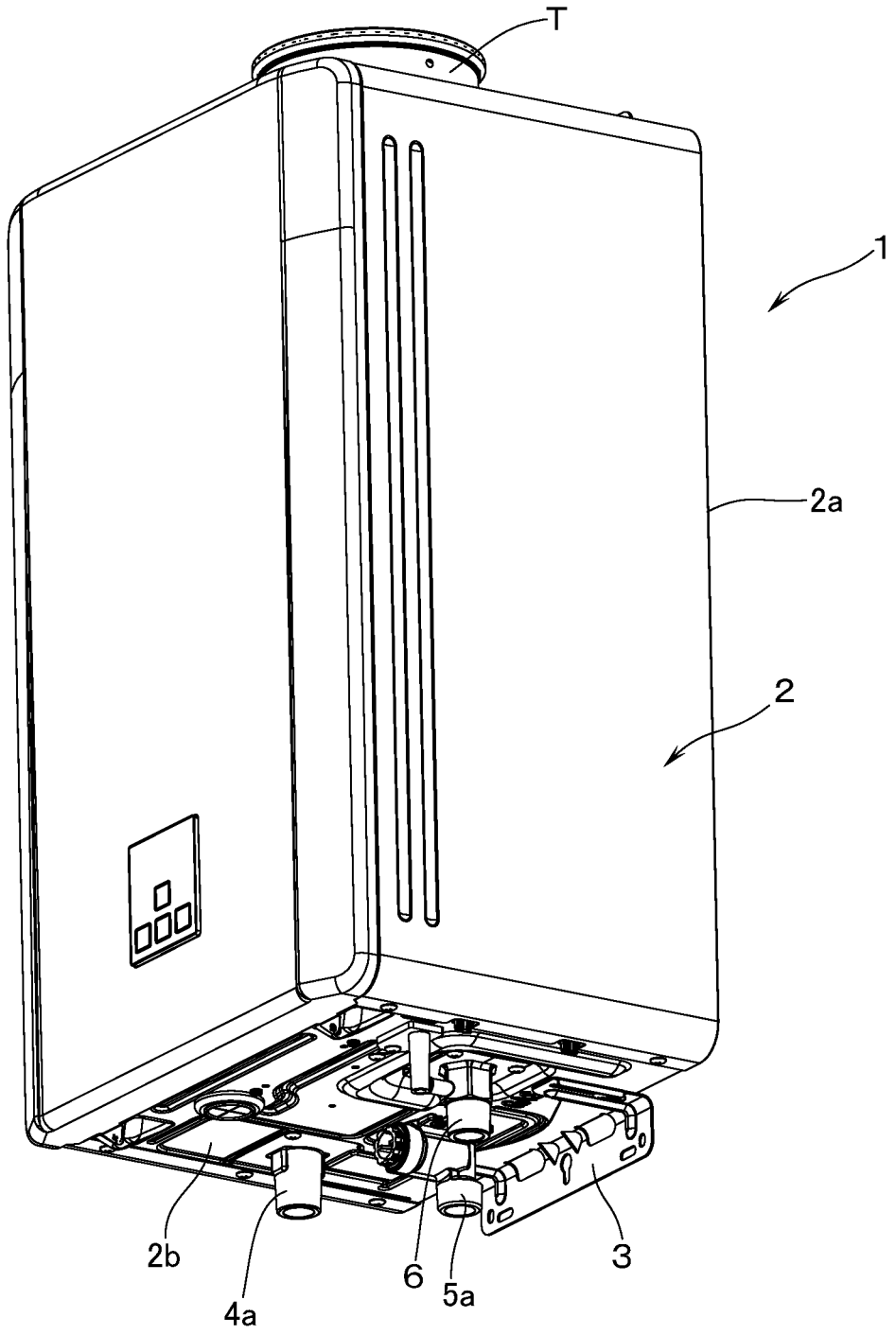
FIG. 1 is a perspective view of an embodiment of a water heater of the invention.

Referring to FIG. 1, the water heater is set on an exterior wall of the like of a building such as a house by fastening with a bolt or the like. For this purpose, in a case 2 provide with the water heater 1, not only a lower fixing piece 3 protruded downward from a lower end of a rear face 2*a* opposite to the exterior wall of the building is provided but also an upper fixing piece, which is not shown and a function of which is similar to the lower piece 3, protrudes upward from an upper end of the rear face 2*a*. Further, in the case 2, each of a downstream end part 4*a* of an outlet pipe, which is described below, extending downward in the case 2 and suspending from a bottom face 2*b*, an upstream end part 5*a* of an inlet pipe, which is described below, crossing perpendicularly with the bottom face 2*b* and entering the case 2, and an upper end part 6 of a fuel-gas supply pipe protrude downwardly. A hot-water supply pipe leading to an outflow faucet is connected with the downstream end part 4*a* of the outlet pipe and a water supply pipe connected with a water pipe is connected with the upper end part 5*a* of the inlet pipe.

Furthermore, a supply and exhaust tube T which extend upwardly and has a cylindrical shape is provided at a top end of the case. In the supply and exhaust tube T, an air supply tube and an exhaust tube are independent of each other in such a manner as being arranged inward and outward in a radial direction. The supply and exhaust tube T sucks an outside air in the case 2 by a rotation of a fan which is described below. The air sucked in the case 2 is mixed with a fuel gas supplied through the above-identified fuel-gas supply pipe in a combustion casing, which is described below, and becomes a gas mixture. Additionally, the supply and exhaust tube T exhausts a combustion gas generated by combustion of the gas mixture in the above-identified combustion housing.

Figure 2:
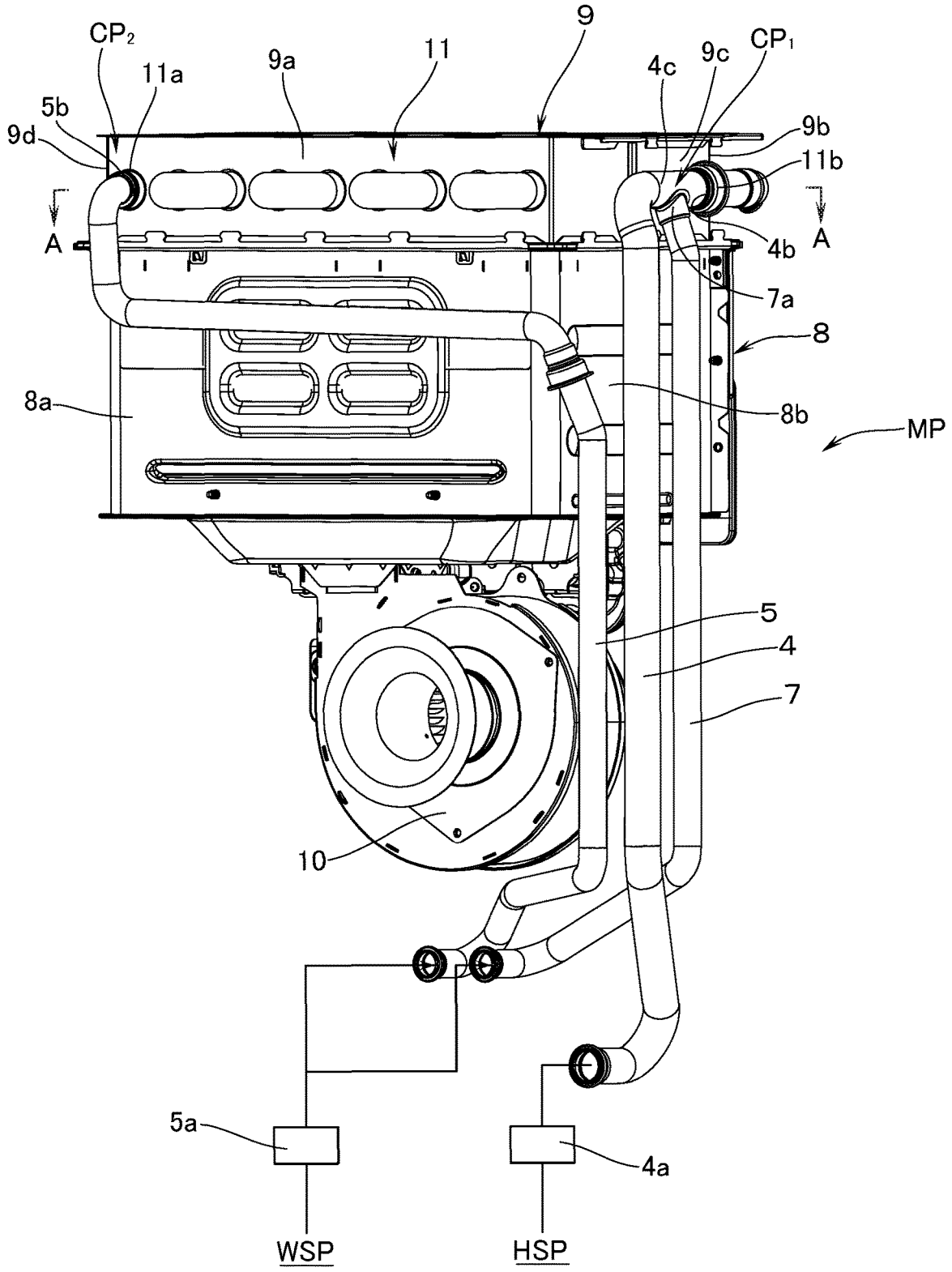
FIG. 2 shows main parts of the water heater shown in FIG. 1.

Referring to FIG. 2, a bypass pipe 7 branches from the inlet pipe 5 at a more downstream part positioned away from the upstream end part 5*a* of the inlet pipe 5, as shown in FIG. 1, and at a more upstream part positioned than at a downstream end 5*b*. Main parts MP of the water heater 1 is housed in the case 2 shown in FIG. 1. The main parts MP is provided with the combustion housing 8, a heat exchanger 9 mounted on an upper end part of the combustion housing 8, the fan 10 arranged under the combustion housing 8. Further, the main parts are provided with the inlet pipe 5 upwardly extending to the heat exchanger 9 in the case 2 shown in FIG. 1, the outlet pipe 4 downwardly extending away from the heat exchanger 9 in the case 2, and the bypass pipe 7 branching from the inlet pipe 5 in the case 2, as above-mentioned, and connected with a more downstream part of the outlet pipe 4.

In the combustion housing 8 and the heat exchanger 9, opposite parts to the rear face 2*a* of the case 2 shown in FIG. 1 are named rear faces 8*a*, 9*a*. Although depictions in FIG. 2 are simplified, the water supply pipe WSP connected with the water pipe is connected with the upstream end part 5*a* of the inlet pipe 5 shown in FIG. 1. Accordingly, the bypass pipe 7 is positioned at the more upstream part than at the branching part from the inlet pipe 5 and is connected with the water supply pipe WSP through a midst part of the inlet pipe 5 leading to the upstream end part 5*a*. The hot-water supply pipe HSP leading to the outlet faucet is connected with the downstream end part 4*a* of the outlet pipe 4.

Figure 3:
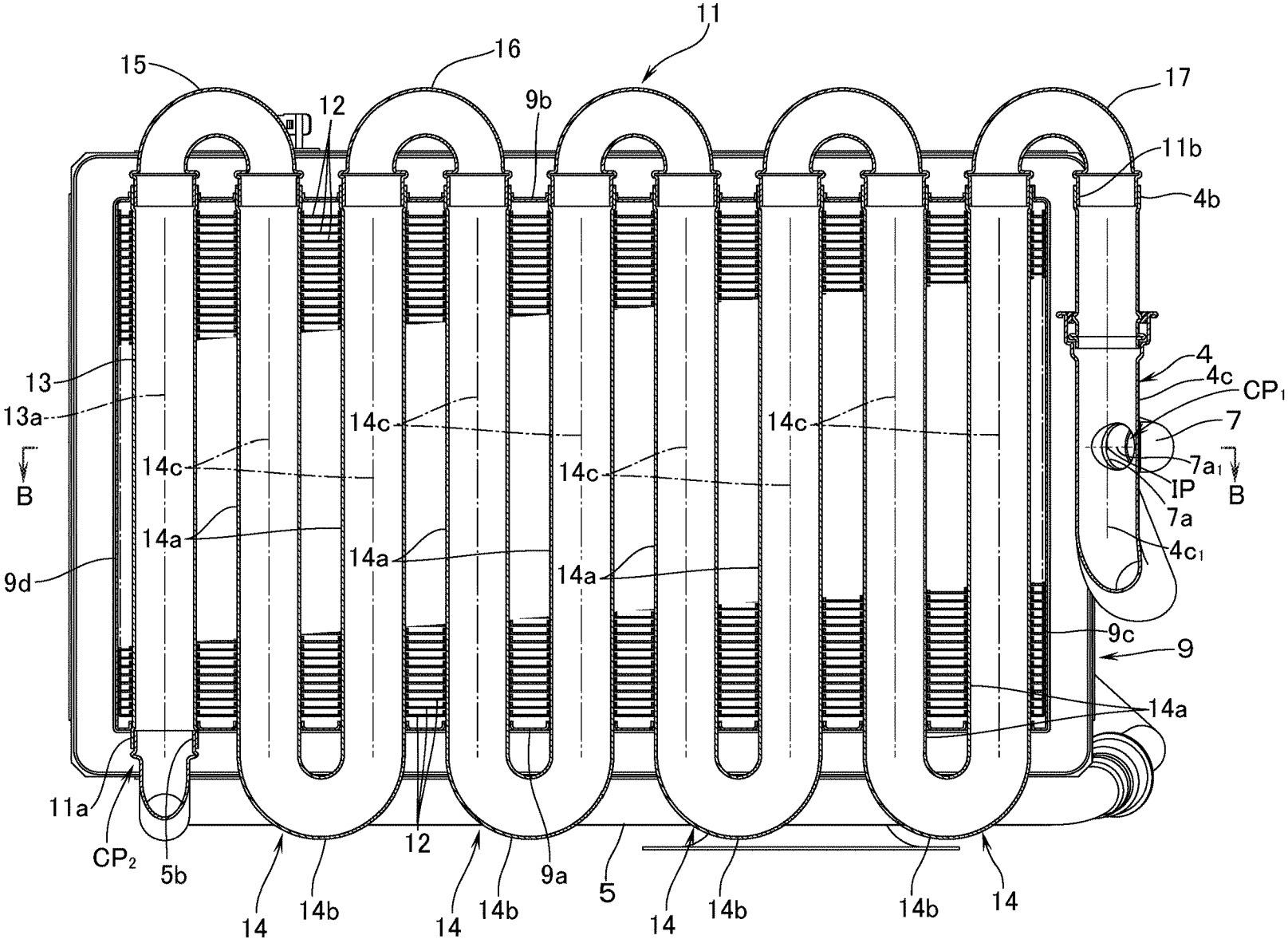
FIG. 3 is a partially sectional view in an A-A direction in FIG. 2.

Additionally, referring to FIG. 3, the inlet 5 upwardly extends around the fan 10 and from the upstream end part 5*a* downwardly positioned away from the heat exchanger 9, and the downstream end 5*b* is connected with an upstream end 11*a* of the water heating channel 11, which protrudes from the rear face 9*a* of the heat exchanger 9.

An upstream end 4*b* of the outlet pipe 4 is connected with a downstream end 11*b* of the water heating channel 11. The downstream end 11*b* of the water heating channel 11 is arranged at an outside of a side face 9*c* of the heat exchanger 9. The outlet pipe 4 extends parallel to the side face 9*c* of the heat exchanger 9 from the downstream end 11*b* of the water heating channel 11 and linearly in a perpendicular direction of both of the rear face 9*a* and front face 9*b* opposite to the rear face 9*a* of the heat exchanger 9. A midst part of the outlet pipe 4 leading to the rear face 9*a* is downwardly bent. The downstream end 7*a* of the bypass pipe 7 branching from the inlet pipe 5 at the above-mentioned part pf the inlet pipe 5 is connected with a lower part of a linear part 4*c* of the outlet pipe 4 by downwardly bending from the upstream end 4*b*. In the embodiment, though the upstream end 4*b* of the outlet pipe 4 is connected with the downstream end 11*b* of the water heating channel 11 and the downstream end 7*a* of the bypass pipe 7 is connected with the lower part of the linear part 4*c* of the outlet pipe 4, it is possible that the downstream end 11*b* of the water heating channel is regarded as a part of the outlet pipe 4. Further, it is possible that the downstream end 11*b* of the water heating channel 11 is regarded as an end positioned at the most downstream part of the heat exchanger 9 and a protruding part from the front face 9*b* of the heat exchanger 9. At any of the above-mentioned cases, the downstream end 7*a* of the bypass pipe 7 is connected with a lower part of the outlet pipe 4 which is connected with a downstream end such as the downstream end 11*b* of the water heating channel 11.

A plurality of fins 12 are provided in a hollow part from the front face 9*b* to the rear face 9*a* of the heat exchanger 9 and each of fins 12 is arranged parallel to the front face 9*b* and rear face 9*a*. The water heating channel 11 is formed by a first heat absorbing pipe 13 having an upstream end, which forms the upstream end 11*a* and a main part of which has a straight-shape, four second heat absorbing pipes 14, each of which is U-shaped and a straight part 14*a* of each of which is arranged parallel to the first absorbing pipe 13, a U-shaped first bent pipe 15 connecting a downstream end of the first absorbing pipe 13 with an upstream end of a straight part 14*a* of the second absorbing pipe 14 which is adjacent to the first heat absorbing pipe 13, three second bent pipes 16 connecting each of downstream ends with each of upstream ends of straight parts 14*a* of the two adjacent second heat absorbing pipes 14, which are similar to the first bent pipe 15, and a third bent pipe 17 connected with a downstream end the straight part 14*a* of the second heat absorbing pipe 14 positioned at the most downstream part, a downstream end of which forms the downstream end 11*d* of the water heating channel 11 and which is similar to the first and second bet pipes 15, 16. Not only the first heat absorbing pipe 13 and each of the second heat absorbing pipes 14 are successively connected through the first and second bent pipes 15, 16 but also the third bent pipe 17 is successively connected with the second heat absorbing pipe 14 positioned at the most downstream part of the water heating channel 11. Accordingly, the water heating channel 11 meanders from the upstream end 11*a* to the downstream end 11*b*. The downstream end 11*b* of the water heating channel 11 may be the downstream end of the straight part 14*a* of the second heat absorbing pipe 14, which is positioned in the most downstream part in the heat exchanger 9 and the downstream end connected with the upstream end of the third bent pipe 17. In this case, the outlet pipe 4 can be regarded as the one containing a pipe leading from the third bent pipe 17 to the linear part 4*c*.

The downstream end of the first heat absorbing pipe 13, the upstream and downstream ends of the straight parts of the second heat absorbing pipes 14 protrude outward so as to come near the front face 9*b* of the heat exchanger 9. Accordingly, the first bent pipe 15, the second bent pipes 14 and the third bent pipe 17 also protrude outward so as to come near the front face 9*b* of the heat exchanger 9. On the other hand, as is similar to the upstream end of the first heat absorbing pipe 13, the U-shaped part of each of the second heat absorbing pipes 14 protrudes outward so as to come near the rear dace 9*a* of the heat exchanger 9. The heat absorbing pipe 13 and each of the second heat absorbing pipes 14 as well as each of the fins 12 may be made of a metal with a high thermal conductivity such as copper.

As shown in FIG. 3, the first heat absorbing pipes 13 and the straight parts 14*a* of the second heat absorbing pipes 14 not only are arranged in parallel with a prescribed distance from the side face 9*c* to the other side face 9*d* positioned at the most upstream part, which is opposite to the side face 9*c*, but also pierce each of the fins 12 in a perpendicular direction. Further, all of the first heat absorbing pipe 13 and each of the straight parts 14*a* of the second heat absorbing pipes 14 are arranged at a same height in the water heater 1 shown in FIG. 1. The "height" referred here is defined by a perpendicular distance from a horizontal plane, which is a standard, such as the bottom face 2*b* of the case 2 of the water heater 1 in a setting state. In other words, each of center lines 13*c*, 14*c* of all of the first heat absorbing pipe 13 and the straight part 14*a* of each of the heat absorbing pipes 14 are arranged in a same horizontal plane HP. Additionally, the U-shaped part 14*b* of each of the second heat absorbing pipes 14, the first bent pipe 15, the second bent pipes 16 and the third bent pipe 17 as well as the first heat absorbing pipe 13 and the straight part 14*a* of each of the second heat absorbing pipes 14 are arranged at a same height.

In the combustion housing 8 in which the above-mentioned heat exchanger 9 is mounted on the top end part, a burner 18 is provided with a lower part from the side face 8*b* of the combustion housing 8 to the side face 8*c* arranged at a lower part of the side face 9*c* of the heat exchanger 9, which is opposite to the side face 8*b*. The burner 18 is provided with nineteen unit-burners 18*a* each of which is arranged at a prescribed clearance. In the burner 18, each of the unit-burner 18*a* is arranged from a side of the rear face 8*a* to a side of a front face opposite to the rear face 8*a*.

As is similar to the conventional water heater, a fuel gas supplied from the above-mentioned fuel gas supply pipe entering the case 2 and through a gas manifold, which is not shown, via a fuel gas pipe connected with the upstream end part 6 of the fuel gas supply pipe is mixed with a first air, which is a part of an outside air surrounding the case 2, sucked from the above-mentioned air supply tube of the air supply and exhaust tube T shown in FIG. 1 by an operation of the fun 10 and a gas mixture of the fuel gas and the first air is supplied in the unit-burners 18*a*. A remaining outside air sucked from the above-mentioned air supply tube through the clearances is supplied at burner ports positioned at a top end of the unit-burners 18*a*. Each of the unit-burners 18*a* is ignited by a spark generated from an ignition electrode accompanied by an operation of an igniter and therefore the burner 18 is ignited. After the ignition of the burner 18, a combustion gas generated by combustion of the fuel gas moves to the heat exchanger 9 from a combustion chamber 8*d* over the burner 18, passes between each of the fins 12, and is exhausted from the above-mentioned air exhaust tube of the air supply and exhaust tube T shown in FIG. 1. When the combustion gas passes between each of the fins 12 of the heat exchanger 9, sensible heat is absorbed in each of the fins 12 and is transmitted to the first heat absorbing pipe 13 and the straight part 14*a* of each of the second heat absorbing pipes 14. At a same time of the ignition of the burner 18, the water is suppled at the upstream end 11*a* of the water heating channel 11 of the heat exchanger 9 from the downstream end 5*b* shown in FIG. 2. The water flowing in the water heating channel 11 is heated by the transmitted heat to the first heat absorbing pipe 13 and the straight part 14*a* of each of the second heat absorbing pipes 14 and becomes the hot water. The hot water flows out the outlet pipe 4 from the downstream end 11*b* and through the upstream end 4*b* of the water heating channel 11.

Since the above-mentioned igniter and the ignition electrode are provided with the conventional water heater, these are omitted in the figures. The ignition of the burner 18, inflow of the water in the water heating channel 11 through the inlet pipe 5, and outflow of the hot water from the water heating channel 11 to the outlet pipe 4 begin by an opening operation of the outflow faucet by a user. Similarly, the outflow of the hot water from the outflow faucet is stopped, the water flow in the water heating channel 11 is stopped, and the burner 18 is put out. Such an automatic operation of the water heater 1 as above-mentioned is similar to that of the conventional water heater. Accordingly, valve units for supplying the water and flowing out the hot water, valve units for supplying and stopping the fuel gas, and a controller or the like for controlling movement of the above-mentioned igniter and each of the above-mentioned valves are omitted in the figures.

As shown in FIG. 2, in the water heater 1, a connecting part $CP_1$ of the bypass pipe 7 with the outlet pipe 4 is arranged at a same height of a connecting part $CP_2$ of the inlet pipe 5 with the upstream end 11*a* of the water heating channel 11. Specifically, the connecting part $CP_1$ is a part where the downstream end 7*a* of the bypass pipe 7 is connected with the linear part 4*c* of the outlet pipe 4 and the connecting part $CP_2$ is a part where the upstream end 11*a* of the water heating channel 11 is connected with the downstream end 5*b* of the inlet pipe 5. The wordings, "same height" is defined by a standard which is such a horizontal plane as the bottom face 2*b* of the case 2 shown in FIG. 1 in the setting state of the state or the like. Further, in other words, a state where the connecting parts $CP_1$, $CP_2$ are positioned at a same height means that a state where an intersection point IP of a center line $4c_1$ of the linear part 4*c* of the outlet pipe 4 with a center line $7a_1$ of the downstream end 7*a* of the bypass pipe 7, and the center line 13*a* of the first heat absorbing pipe 13 structuring a part of the water heating channel 11 exist in a horizontal plane HP shown in FIG. 4.

In general, a water temperature at the upstream end 11*a* of the water heating channel 11 is about from 5° C. to 25° C. and a hot-water temperature at the downstream end 11*b* is about from 50° C. to 70° C. As a temperature of the water rises beyond 4° C., a specific gravity of the water decreases. Accordingly, a weight of the hot water at the downstream end 11*b* of the water heating channel 11 is lighter than that of the water at the upstream end 11*a* of the water heating channel 11. However, as above-mentioned, the connecting part $CP_1$ of the bypass pipe 7 with the outlet pipe 4 and the connecting part $CP_2$ of the inlet pipe 5 with the upstream end 11*a* of the water heating channel 11 are positioned at the same height and therefore, even though there is difference in the specific gravity between the water and the hot water, either the remaining hot water in the outlet pipe 4 does not upwardly flow in the outlet pipe 4 or the remaining water in a part near the upstream end 11*a* of the water heating channel 11, in the inlet pipe 5 and in the bypass pipe 7 does not flow in the outlet pipe 4. Accordingly, if a passing time from stoppage of outflow to resumption of outflow is prolonged, it is possible that outflow of fluid mixture at a lower temperature than at a preset temperature from the outflow faucet is suppressed.

Figure 4:
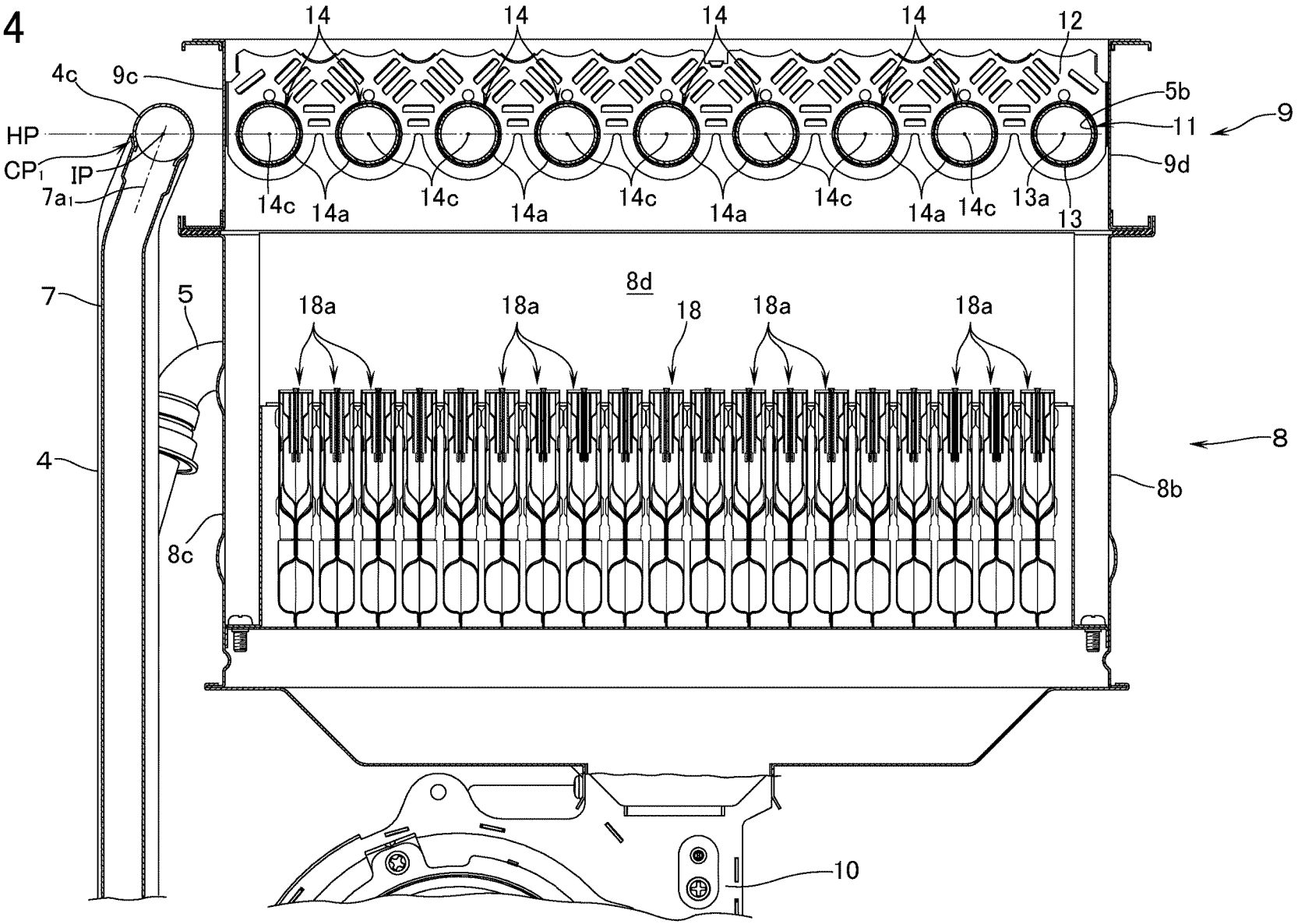
FIG. 4 is a partially sectional view in a B-B direction in FIG. 3.

As shown in FIGS. 3 and 4, in the water heater 1, the first heat absorbing pipe 13, the second heat absorbing pipes 14, the first bent pipe 15, the second bent pipes 16, and the third bent pipe 17 forming the water heating channel 11 of the heat exchanger 9 are arranged at the same height and in a single horizontal plane. As compared with a heat exchanger provided with a plurality of the water heating channels 11 formed by such heat absorbing pipes or the like as the above-mentioned, each of the water heating channels 11 of which is arranged in a perpendicular direction, i.e., arranged in a different horizontal plane, and is successively connected, in the case where a water temperature at the upstream end 11*a* of the water heating channel 11 positioned in the lowest horizontal plane is as low as that of the water heating channel 11 arranged in a single horizontal plane and a hot-water temperature at the downstream end 11*b* of the water heating channel 11 arranged in the highest horizontal plane is as high as that of the water heating channel 11 arranged in a single horizontal plane, a temperature change amount of the water heating channel 11 of the heat exchanger 9 is larger than that of each of the water heating channels 11 provide with the heat exchanger and arranged in the different horizontal planes. The above-mentioned explanation is now specifically described as follows: A heat exchanger provided with two water heating channels 11 is exemplified. One of the water heating channels 11 is arranged in one horizontal plane and the other in the other horizontal plane. The former names an upper water heating channel 11 and the latter a lower water heating channel 11. The upper water heating channel 11 is successively connected with the lower water heating channel 11, the upstream end 11*a* is provided with the lower water heating channel 11, and the downstream end 11*b* is provided with the upper water heating channel 11. In this heat exchanger, since relatively hot water after being heated in the lower water heating channel 11 flows in the upper water heating channel 11, the hot water with relatively small heat conductivity remains in the upper water heating channel and therefore the temperature change amount per one water heating channels is smaller. On the contrary, in the heat exchanger 9 in which the water heating channel 11 is arranged in the single horizontal plane, since all of the heat absorbing pipes are arranged at the same height, the hot water and the water remain in one water heating channel 11 and therefore the heat temperature change amount is larger. Further, in order to absorb same amount of heat, it is necessary for the heat changer 9 with one water heating channel 11 that a length of the water heating channel 11 is longer and amount of the remaining hot water and water in the water heating channel 11 is more as compared with the heat exchanger provided with two water heating channels 11. Accordingly, suppressing movement of the hot water and the water is harder after the stoppage of outflow and the outlet pipe 4 has a length to some extent so that the hot water upwardly flows and backflows in the water heating channel 11, resulting in easily taking place the reverse flow of the hot water. However, the suppress of the reverse hot-water flow becomes excellent by the heat exchanger 9 aligned the water heating channel 11 in the single horizontal plane because, as above-mentioned, the connecting part $CP_1$ of the bypass pipe 7 with the outlet pipe 4 and the connecting part $CP_2$ of the inlet pipe 5 with the upstream end 11*a* of the water heating channel 11 are arranged at the same height.

Though the invention is described base on the above-mentioned embodiment, the invention is not limited to the above-mentioned embodiment. The shape and the number or the like of the heat absorbing pipe structuring the water heating channel 11 is not specifically limited, for example. Further, the shape or the like of the inlet pipe 5, the outlet pipe 4 and the bypass pipe 7 is not specifically limited. Furthermore, the structure of the valve units except the main parts MP, the controller, the burner 18 or the like are not specifically limited. In addition, a plurality of the water heating channels 11 each of which is arrange at a different height in the heat exchanger 9 so long as the connecting part $CP_1$ of the bypass pipe 7 with the outlet pipe 4 and the connecting part $CP_2$ of the inlet pipe 5 with the upper end 11*a* of the water heating channel 11 are arranged at the same height. In this case, each of the water heating channels 11 can be arranged at the different height by interposing a member, such as a header, which branches in a perpendicular direction both near the downstream end 5*b* of the inlet pipe 5 and near the upstream end 4*b* of the outlet pipe 4, and each of the water heating channels 11 is connected with each of branched water channels provided with the above-mentioned member and arranged in a perpendicular direction. In other words, each of the water heating channels 11 arranged in a different horizontal plane at a constant distance is connected both with the inlet pipe 5 and with the outlet pipe 4. Further, in the above-mentioned case, the connecting part $CP_1$ of the bypass pipe 5 with the outlet pipe 4 is arranged at a more upstream part of the above-mentioned member and the connecting part $CP_2$ of the inlet pipe 5 with the upstream end 11*a* of each of the water heating channels 11 is arranged at a more downstream part of the above-mentioned member.

It is possible that the invention is also adapted to a water heater with which the heat exchanger 9 and a heat exchanger for heating a room or the like are provided.

EXPLANATION OF SYMBOLS

1 Water heater
4 Outlet pipe
4*b* Upstream end of outlet pipe 4
5 Inlet pipe
5*b* Downstream end of inlet pipe 5
7 Bypass pipe
9 Heat exchanger
11 Water heating channel
11*a* Upstream end of water heating channel
13 Heat absorbing pipe, i.e., first heat absorbing pipe
14 Heat absorbing pipe, i.e., second heat absorbing pipe
18 Heat resource, i.e., burner
$CP_1$ Connecting part pf bypass pipe 7 with outlet pipe 4
$CP_2$ Connecting part of inlet pipe 5 with upstream end 11*a* of water heating channel 11

What is claimed is:

1. A water heater provided with a heat exchanger which has a water heating channel structured by successively connecting each of a plurality of heat absorbing pipes aligned in parallel and produces hot water by heating water while flowing water in the water heating channel, and a heat resource for heating the heat exchanger, comprising, an inlet pipe upwardly extending to the heat exchanger for introducing the water into the water heating channel, a downstream end of which is connected with an upstream end of the water heating channel of the heat exchanger;

an outlet pipe, an upstream end of which is connected with a downstream end of the water heating channel of the heat exchanger, the outlet pipe extending away from the heat exchanger for downwardly flowing the hot water out of the water heating channel;

a bypass pipe branching at a part of the inlet pipe, which is positioned at a more upstream part than at the downstream end, the bypass pipe being connected always with the inlet pipe and with a part of the outlet pipe, which is positioned at a more downstream part than at the upstream end, and mixing water from the water heating channel and water from the bypass pipe in the outlet pipe, wherein a connecting part of the bypass pipe with the outlet pipe and a connecting part of the inlet pipe with the upstream end of the water heating channel are arranged at a same height in a setting state of the water heater so that the water remaining in the bypass pipe does not flow from a connection between the bypass pipe and the outlet pipe into a portion of the outlet pipe after hot water has stopped.

2. The water heater as claimed in claim 1, wherein all of the heat absorbing pipes structuring the water heating channel of the water heater are arranged at a same height and in a single horizontal plane.

3. The water heater as claimed in claim 1, wherein the bypass pipe is a single bypass pipe.

4. The water heater as claimed in claim 1, wherein the connecting part of the bypass pipe and the connecting part of the inlet pipe are arranged at the same height so that when a passing time from stoppage of outflow to resumption of outflow is prolonged, outflow of fluid mixture at a lower temperature than at a present temperature from the outlet pipe is suppressed.

* * * * *